US012480516B2

(12) United States Patent
Corralejo Anton et al.

(10) Patent No.: US 12,480,516 B2
(45) **Date of Patent: *Nov. 25, 2025**

(54) COMPRESSOR

(71) Applicant: Dyson Technology Limited, Wiltshire (GB)

(72) Inventors: Raul Corralejo Anton, Burgos (ES); Robert James Kyle, Bristol (GB); Christopher Ashley Monk, Royal Wootton Bassett (GB)

(73) Assignee: Dyson Technology Limited, Malmesbury (GB)

( * ) Notice: Subject to any disclaimer, the term of this patent is extended or adjusted under 35 U.S.C. 154(b) by 0 days.

This patent is subject to a terminal disclaimer.

(21) Appl. No.: 18/290,271

(22) PCT Filed: May 6, 2022

(86) PCT No.: PCT/GB2022/051158

§ 371 (c)(1),
(2) Date: Nov. 10, 2023

(87) PCT Pub. No.: WO2022/238685

PCT Pub. Date: Nov. 17, 2022

(65) Prior Publication Data

US 2024/0229815 A1 Jul. 11, 2024

(30) Foreign Application Priority Data

May 13, 2021 (GB) ..... 2106830

(51) Int. Cl.
*F04D 29/08* (2006.01)
*F01D 11/02* (2006.01)
(Continued)

(52) U.S. Cl.
CPC ..... *F04D 29/083* (2013.01); *F01D 11/02* (2013.01); *F04D 17/06* (2013.01); *F04D 29/161* (2013.01);
(Continued)

(58) Field of Classification Search
CPC ..... F04D 29/083; F04D 17/06; F04D 29/161; F04D 29/162; F04D 29/281; F04D 29/441; F01D 11/02
See application file for complete search history.

(56) References Cited

U.S. PATENT DOCUMENTS 3,307,776 A * 3/1967 White ..... F04D 29/162 415/914
4,286,919 A 9/1981 Yamaguchi
(Continued)

FOREIGN PATENT DOCUMENTS

CN 1334407 A 2/2002
CN 206600230 U 10/2017
(Continued)

OTHER PUBLICATIONS

Examination Report received for GB Application No. 2106830.9, mailed on Jul. 26, 2023, 2 pages.
(Continued)

*Primary Examiner* — Andrew J Marien
(74) *Attorney, Agent, or Firm* — Tucker Ellis LLP

(57) ABSTRACT

A compressor is provided for use in domestic appliances. The compressor includes: an impeller including an inlet, an outlet, a hub defining a rotational axis of the impeller, a plurality of impeller blades that extend from the hub, and a shroud that at least partially surrounds the impeller blades; a housing that at least partially surrounds the shroud and that is coaxially arranged with respect to the rotational axis of the impeller to allow the impeller to rotate within the housing;
(Continued)

a leakage flow path defined between the shroud and the housing leading from a leakage flow path inlet to a reinjection port, and a labyrinth seal arrangement provided in the leakage flow path. The labyrinth seal arrangement includes one or more shroud rings interdigitated with one or more housing rings so as to form a tortuous flow path for fluid flowing through the leakage flow path.

18 Claims, 5 Drawing Sheets

(51) Int. Cl.

| | |
|---|---|
| ***F04D 17/06*** | (2006.01) |
| ***F04D 29/16*** | (2006.01) |
| ***F04D 29/28*** | (2006.01) |
| ***F04D 29/44*** | (2006.01) |

(52) U.S. Cl.
CPC ..... *F04D 29/162* (2013.01); *F04D 29/281* (2013.01); *F04D 29/441* (2013.01)

(56) References Cited

U.S. PATENT DOCUMENTS

| | | | | |
|---|---|---|---|---|
| 4,357,914 | A | 11/1982 | Hauser | |
| 4,375,937 | A * | 3/1983 | Cooper | F04D 15/00 415/58.4 |
| 4,432,694 | A | 2/1984 | Kuroda et al. | |
| 4,834,611 | A * | 5/1989 | Meng | F04D 29/2277 415/914 |
| 4,854,818 | A * | 8/1989 | Meng | F04D 29/4273 415/58.4 |
| 4,978,278 | A | 12/1990 | Kun | |
| 5,743,710 | A * | 4/1998 | Yapp | F04D 17/165 415/208.2 |
| 8,475,111 | B2 | 7/2013 | Stagg et al. | |
| 9,334,877 | B2 | 5/2016 | Nicholls et al. | |
| 9,404,502 | B2 | 8/2016 | Ishikawa | |
| 10,072,557 | B2 * | 9/2018 | Gullberg | F04D 17/10 |
| 11,460,039 | B2 * | 10/2022 | Fournier | F04D 29/281 |
| 2008/0279681 | A1 * | 11/2008 | Eguchi | F04D 29/444 415/206 |
| 2009/0205360 | A1 * | 8/2009 | Haley | F04D 29/4213 417/423.1 |
| 2010/0143105 | A1 | 6/2010 | Goto et al. | |
| 2012/0020778 | A1 * | 1/2012 | Ruck | F04D 29/281 415/208.1 |
| 2014/0154078 | A1 * | 6/2014 | Ahn | F01D 1/023 416/174 |
| 2014/0255178 | A1 * | 9/2014 | Oudin | F01D 25/28 415/208.1 |
| 2015/0098817 | A1 | 4/2015 | Innocenti | |
| 2015/0211541 | A1 * | 7/2015 | Gamissans Bou | F04D 29/162 415/174.5 |
| 2016/0201693 | A1 * | 7/2016 | An | F04D 17/10 415/58.4 |
| 2018/0135643 | A1 | 5/2018 | Kawaguchi et al. | |
| 2021/0108649 | A1 | 4/2021 | Demory et al. | |

FOREIGN PATENT DOCUMENTS

| | | | |
|---|---|---|---|
| DE | 3128654 | A1 | 8/1982 |
| EP | 2896838 | A1 | 7/2015 |
| FR | 2879266 | A1 | 6/2006 |
| JP | 01-208599 | A | 8/1989 |
| JP | 11-343996 | A | 12/1999 |
| JP | 2010-053815 | A | 3/2010 |
| WO | 98/45601 | A1 | 10/1998 |
| WO | 2010/092802 | A1 | 8/2010 |
| WO | 2017/082222 | A1 | 5/2017 |
| WO | 2018/185411 | A1 | 10/2018 |
| WO | 2019/239174 | A1 | 12/2019 |
| WO | 2022/238685 | A1 | 11/2022 |
| WO | 2022/238686 | A1 | 11/2022 |

OTHER PUBLICATIONS

Examination Report received for GB Application No. 2106831.7, mailed on Jul. 26, 2023, 2 pages.
International Search Report and Written Opinion received for PCT Patent Application No. PCT/GB2022/051158, mailed on Aug. 10, 2022, 11 pages.
International Search Report and Written Opinion received for PCT Patent Application No. PCT/GB2022/051159, mailed on Aug. 10, 2022, 11 pages.
Search Report received for GB Application No. 2106830.9, mailed on Oct. 18, 2021, 2 pages.
Search Report received for GB Application No. 2106831.7, mailed on Oct. 18, 2021, 2 pages.

* cited by examiner

COMPRESSOR

CROSS-REFERENCE TO PRIOR APPLICATIONS

This application is a § 371 National Stage Application of PCT International Application No. PCT/GB2022/051158 filed May 6, 2022, which claims the priority of United Kingdom Application No. 2106830.9, filed May 13, 2021, each of which are herein incorporated by reference in their entirety.

TECHNICAL FIELD

The present invention relates to a compressor for use in domestic appliances and to a fan assembly comprising a compressor.

BACKGROUND

Many domestic appliances use fluid displacement devices such as pumps, fans and compressors to pump fluid such as water or air from one place to another, and in the case of compressors to compress and pressurise fluid. Typical examples of fluid displacement devices used in domestic appliances are pumps for refrigerators, washing machines and dishwashers, and fans and compressors for floor and table top fans, and for cooling devices used in consumer electronics such as computers and laptops.

Known compressor arrangements include an impeller that is rotatable within a stationary housing. The impeller includes a hub and a plurality of impeller blades that extend from the outer surface of the hub. The hub is connected to a rotary shaft that is driven by an electric motor in use. In some examples, a shroud may be arranged to surround and rotate with the hub and the blades. In use, air is drawn into the compressor through an inlet before flowing through the impeller and being expelled from the compressor via an outlet.

Ideally all air drawn in at the inlet of the compressor would flow through the impeller and to the outlet for optimal compressor performance. However, in practice some amount of air will leak out through the small clearance that exists between the stationary housing and the rotating blade tips or shroud during operation. This tip leakage results in pressure losses which reduce the overall performance of the compressor, and result in unwanted noise from the compressor.

Air that flows through the tip leakage path in this way flows back towards the impeller inlet and is reinjected back through the impeller. This air is already swirling on exit from the impeller, and further swirl is induced by boundary layer friction as the air passes the front surface of the shroud as it flows through the tip leakage path. This swirling air further reduces efficiency and creates additional noise when reinjected at the inlet of the impeller.

It is against this background that the present invention has been devised.

SUMMARY OF THE INVENTION

In an aspect of the invention there is provided a compressor for use in domestic appliances. The compressor comprises: an impeller comprising an inlet, an outlet, a hub defining a rotational axis of the impeller, a plurality of impeller blades that extend from the hub, and a shroud that at least partially surrounds the impeller blades; a housing that at least partially surrounds the shroud and that is coaxially arranged with respect to the rotational axis of the impeller to allow the impeller to rotate within the housing; and a leakage flow path defined between the shroud and the housing leading from a leakage flow path inlet to a leakage flow path outlet. The compressor further comprises a labyrinth seal arrangement provided in the leakage flow path. The labyrinth seal arrangement comprises one or more shroud rings interdigitated with one or more housing rings so as to form a tortuous flow path for fluid flowing through the leakage flow path.

By virtue of the interlocking or interleaving shroud and housing rings, the labyrinth seal arrangement of the invention advantageously provides a long and circuitous flow route for air flowing through the leakage flow path. On passage through the labyrinth seal arrangement, the leakage flow must navigate numerous changes of direction whilst travelling through the tight clearance between the shroud and the housing due to the interlocking nature of the shroud and housing rings. In this way, the labyrinth seal arrangement advantageously reduces the rate of flow of air through the leakage flow path from the impeller outlet back to the impeller inlet.

One or more of the shroud rings and one or more of the housing rings may extend substantially parallel to the rotational axis of the impeller. This arrangement allows for a maximum number of shroud and housing rings in compressors in which the radial dimension of the package is limited.

One or more of the shroud rings and one or more of the housing rings may extend substantially perpendicularly to the rotational axis of the impeller. One or more of the shroud rings and one or more of the housing rings may extend transversely to the rotational axis of the impeller, in an oblique orientation that is between the parallel and perpendicular orientations.

One or more of the shroud rings may extend continuously about the shroud. Correspondingly, one or more of the housing rings may extend continuously about the housing.

Respective tips of two or more of the shroud rings may terminate in axial alignment with one another. In this respect, respective axial lengths of the shroud rings may be greater than 30% of the axial length of the impeller.

The compressor may comprise a flow straightening arrangement having an inlet at an outlet of the labyrinth seal arrangement. Providing a flow straightening arrangement at the outlet of the labyrinth seal arrangement allows for swirl to be removed from the air flow before it is reinjected into the impeller.

An outlet of the flow straightening arrangement may be spaced from the leakage flow path outlet so as to define at least in part a wake recovery chamber upstream of the leakage flow path outlet. In embodiments including a wake recovery chamber, this chamber acts as a flow homogenising zone between the flow straightening arrangement and the leakage flow path outlet. This benefits the tonal content of the air flow exiting the flow straightening arrangement, and allows the aerodynamic wakes that may be created on flow of air through the flow straightening arrangement to mix out before interacting with the impeller blades on reinjection into the impeller.

An axial length of the flow straightening arrangement may be substantially equal to or less than an axial distance between the outlet of the flow straightening arrangement and the leakage flow path outlet, so as to provide a suitable spacing between the flow straightening arrangement and the reinjection port for wake recovery.

In some embodiments the flow straightening arrangement may comprise at least one of a mesh, a foam body and/or a plurality of straightening vanes. In embodiments incorporating straightening vanes, these vanes may be equally spaced about the rotational axis of the impeller. The number of straightening vanes may be greater than the number of impeller blades. The number of straightening vanes may be unequal to a multiple of the number of impeller blades. The axial length of each straightening vane may be greater than the circumferential distance between adjacent straightening vanes.

The impeller may be a mixed flow impeller.

In another aspect of the invention, there is provided a fan assembly comprising a compressor as described in any of the preceding paragraphs.

BRIEF DESCRIPTION OF THE DRAWINGS

Embodiments of the invention will now be described by way of example with reference to the accompanying drawings, in which.

DETAILED DESCRIPTION

Figure 1:
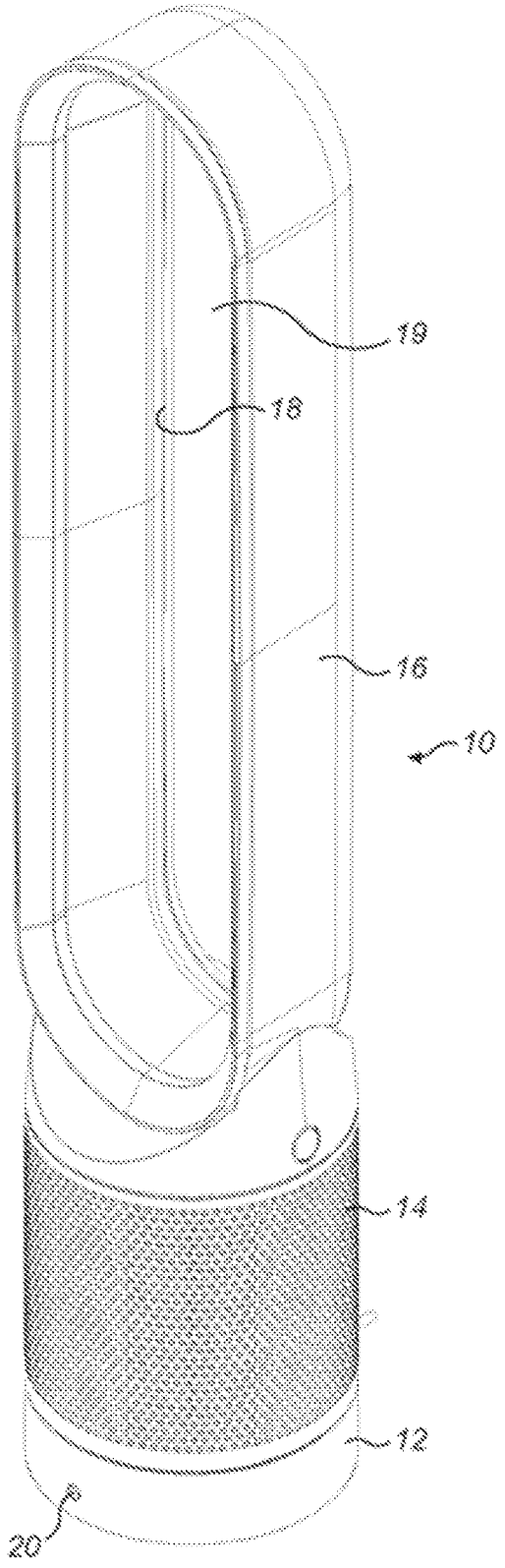
FIG. 1 shows a fan assembly in which a compressor in accordance with the invention may be used.

FIG. 1 shows a fan assembly 8 in which a compressor 10 in accordance with the invention may be used.

Depending on the specific arrangement, the fan assembly 8 may function as an ordinary fan, an air conditioner, an air purifier and/or a heater. However, it is noted that these are non-limiting examples of domestic appliances that may use a compressor 10 according to the invention, and that other examples are possible. Other devices that may utilise a compressor 10 in accordance with the invention include but are not limited to hair dryers, hand dryers, cooling fans for computers and consumer electronics, ovens, refrigerators and washing machines.

The fan assembly 8 comprises a body 12, and a removable filter 14 and annular nozzle 16 mounted on the body 12. It should be noted that the compressor 10 is housed within the body 12, and is therefore concealed in FIG. 1. The nozzle 16 has an elongate annular shape and has an air outlet 18 for emitting a primary air flow from the fan assembly 8. The nozzle 16 defines an opening or bore 19 through which air from outside of the fan assembly 8 is drawn by the air emitted from the outlet 18. The body 12 further comprises a user interface that allows a user to control the operation of the fan assembly 8, which in this example comprises a button 20. The fan assembly 8 may also be provided with a remote-control unit to enable operation of the fan assembly 8 to be controlled remotely.

Figure 2:
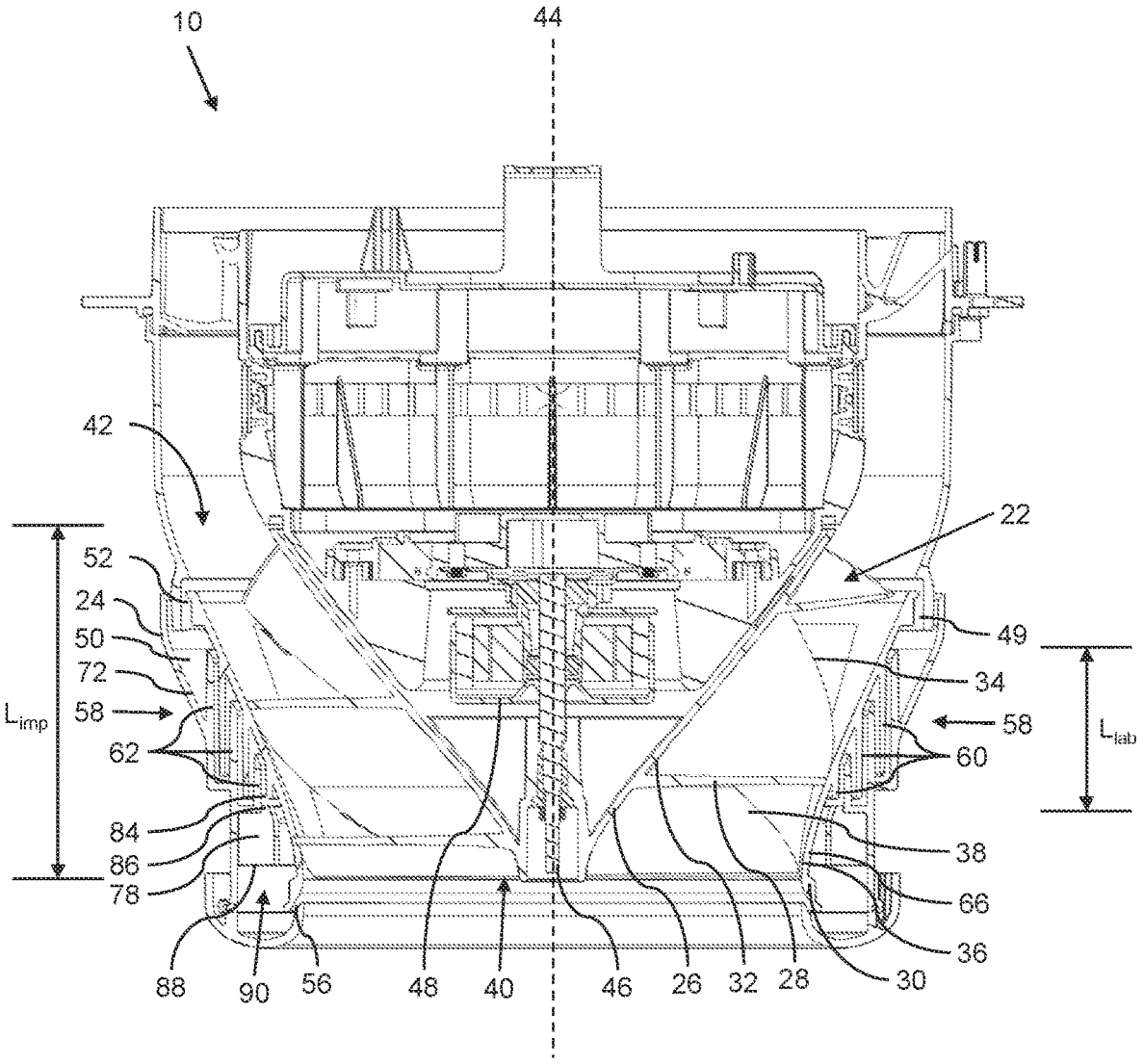
FIG. 2 is a cross sectional view of a compressor in accordance with the invention, including a labyrinth seal arrangement in a leakage flow path and a flow straightening arrangement at the outlet of the leakage flow path.

FIG. 2 shows a compressor 10 in accordance with an embodiment of the invention. The compressor 10 comprises an impeller 22 and a housing 24 that surrounds at least a portion of the impeller 22. In use, the impeller 22 rotates within the housing 24, which remains stationary, to drive air through the compressor 10.

The impeller 22 comprises a generally conical hub 26, a plurality of blades 28 attached to the hub 26, and a generally frustoconical shroud 30 that at least partially surrounds the hub 26 and the blades 28, and that is attached to the blades 28. In the conventional manner with such mixed flow compressors, the blades extend about the hub 26 in helical paths. The blades 28 extend outwardly from an outer surface 32 of the hub and terminate in blade tips 34 that are attached to an inner surface 36 of the shroud 30.

The impeller 22 further comprises a duct 38 through which air flows through the impeller 22 in use. The duct 38 is defined between the outer surface 32 of the hub 26 and the inner surface 36 of the surrounding shroud 30, such that the hub outer surface 32 defines an inner wall of the duct 38 and the shroud inner surface 36 defines an outer wall of the duct 38. A first end of the duct 38 (the lower end in FIG. 2) defines an impeller inlet 40 for receiving air into the impeller 22, and a second end of the duct 38 (the upper end in FIG. 2) defines an impeller outlet 42 from which air is expelled from the impeller 22.

In use, the impeller hub 26 is driven to rotate about a rotational axis 44 of the impeller 22 that is defined by the longitudinal axis of the hub 26. Rotation of the impeller hub 26 causes the impeller blades 28 to draw air into the impeller 22 via the impeller inlet 42, and through the duct 38 towards the impeller outlet 42 from where air exits the impeller 22.

For this, the impeller 22 is connected to a rotary shaft 46 that extends along the longitudinal axis of the hub 26 from a motor 48 housed within the hub 26. In this embodiment, the motor 48 is a DC brushless motor having a variable speed which can be controlled via a control circuit (not shown) in response to user selection. The maximum speed of the motor 48 is typically in the range from 1,000 to 10,000 rpm when the compressor 10 is utilised in a fan assembly 8 such as that shown in FIG. 1, depending on the size of the fan assembly 8 and the desired air flow.

The housing 24 surrounds at least a portion of the impeller 22, and in particular at least a portion of the impeller shroud 30. The housing 24 is coaxially arranged with respect to the rotational axis 44 of the impeller 22 and a clearance 49 is required between the housing 24 and the shroud 30 to allow the impeller 22 to rotate within the housing 24 when driven by the motor 48 in use.

For a typical impeller 22 and motor 48 as described above, pressure differences between the inlet 40 and the outlet 42 of the impeller 22 are usually between about 100 Pa and 1000 Pa. Of course, many design parameters influence the obtainable pressure difference between the inlet 40 and the outlet 42 of the impeller 22, and different applications may require different pressure differentials. In vacuum cleaners, for example, the generated pressure difference can easily exceed 20 kPa.

In use, the pressure differential between the inlet 40 and the outlet 42 of the impeller 22 causes high pressure air at the impeller outlet 42 to be forced back through the clearance 49 that exists between the shroud 30 and the housing 24 to allow for rotation of the impeller 22. The clearance 49 therefore defines a leakage flow path 50 between the shroud 30 and the housing 24. The leakage flow path 50 leads from a leakage flow path inlet 52 that is generally aligned with the impeller outlet 42 along the rotational axis 44 of the impeller 22 to a leakage flow path outlet 56.

The leakage flow path outlet 56 is defined by an opening between the housing 24 and the shroud 30 that is generally aligned with the impeller inlet 40 along the rotational axis 44 of the impeller 22. The leakage flow path outlet 56 therefore functions as a reinjection port through which air from the leakage flow path 50 flows back into the impeller 22 via the impeller inlet 40.

Air flow from the impeller outlet 42 back through the leakage flow path 50, known as tip leakage, is disadvantageous as it leads to pressure losses in the system that can reduce the overall performance of the compressor 10, in addition to creating unwanted noise.

In order to reduce tip leakage, the clearance 49 between the shroud 30 and the housing 24 is kept as small as possible, within the engineering tolerance levels of the manufacturing and assembly process of the compressor 10. To further reduce tip leakage, the compressor 10 is provided with a labyrinth seal arrangement 58 provided in the leakage flow path 50, as will now be described.

Figure 3:
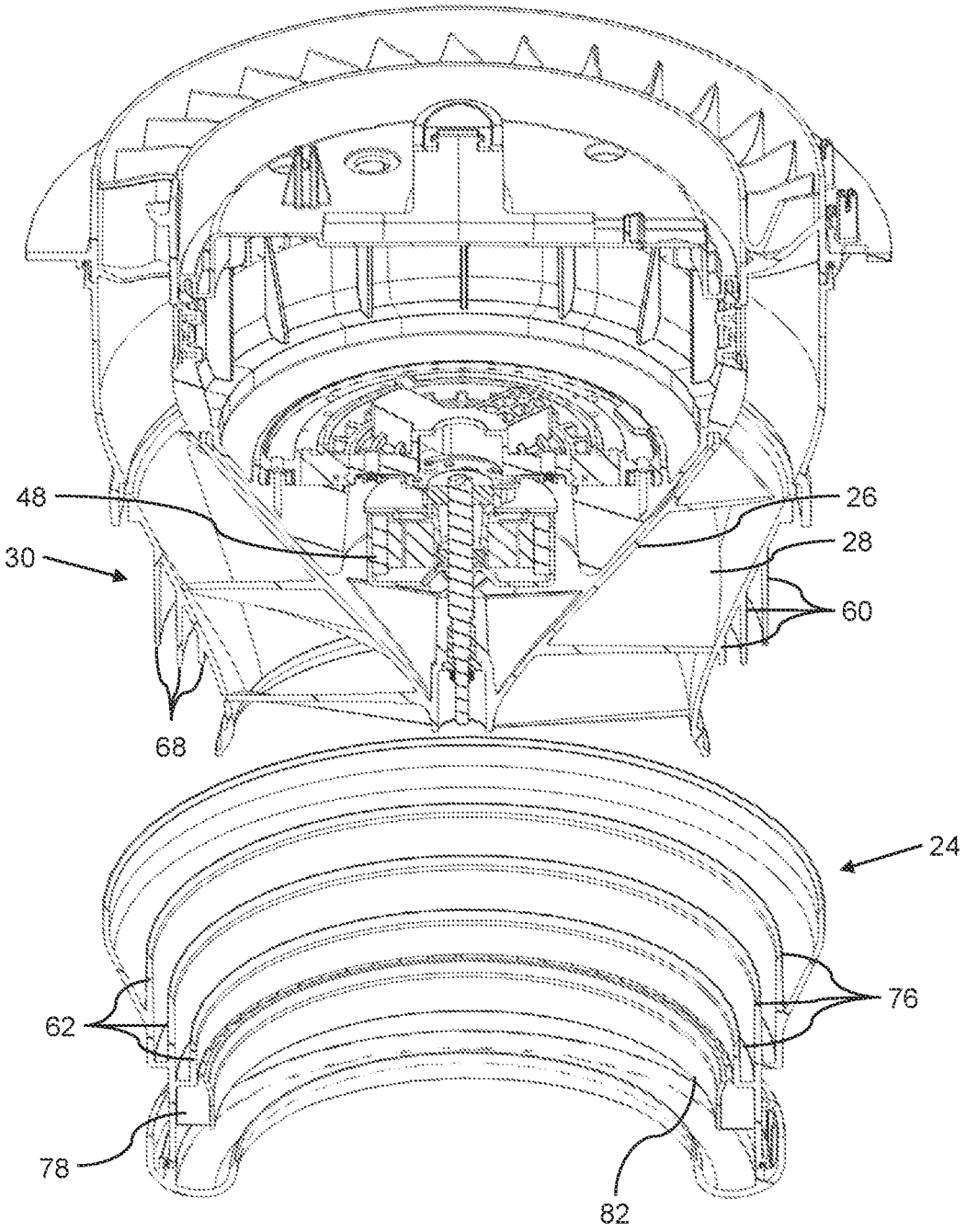
FIG. 3 is an exploded view of the compressor of FIG. 2, showing shroud rings of a shroud of the impeller and housing rings of a compressor housing that together define the labyrinth seal arrangement.

With reference to both FIGS. 2 and 3, the labyrinth seal arrangement 58 comprises a plurality of shroud rings 60 interdigitated with a plurality of housing rings 62. In this embodiment the labyrinth seal arrangement 58 includes three shroud rings 60 and three housing rings 62. More or fewer shroud and/or housing rings 60, 62 may be included in other embodiments. However, the labyrinth seal arrangement 58 preferably includes the maximum number of interdigitated rings 60, 62 possible within the constraints of the compressor package space and manufacturing limitations, so as to provide the most circuitous flow route possible in the leakage flow path 50 and in turn provide the greatest possible reduction in flow rate through the leakage flow path 50.

It will be appreciated from FIGS. 2 and 3 that the labyrinth seal arrangement 58 extends along only a portion of the axial length of the impeller 22, defined as the length of the impeller along its longitudinal axis, in this embodiment. The axial length of the labyrinth seal arrangement 58 is shown as dimension '$L_{lab}$' in FIG. 2, and the axial length of the impeller 22 is shown as dimension '$L_{imp}$'. However, in other embodiments the labyrinth seal arrangement 58 may extend over a greater or lesser proportion of the axial length of the impeller 22. Furthermore, in embodiments in which the labyrinth seal arrangement 58 does not extend along the full axial length of the impeller 22, the labyrinth seal arrangement 58 may include multiple labyrinth seals in the leakage flow path 50 that are axially separated from one another. For example, the labyrinth seal arrangement 58 may include a first labyrinth seal towards the impeller inlet 40 and a second labyrinth seal towards to the impeller outlet 42.

Each shroud ring 60 is defined by an annular projection that extends from an outer surface 66 of the shroud 30 and that is generally rectangular in cross-section. The shroud rings 60 are radially spaced from one another on the shroud 30 so as to define a pattern of concentric rings, and each shroud ring 60 extends continuously about a circumference of the shroud 30. Although it is envisaged that the shroud rings will be continuous, in some embodiments, the shroud rings may be discontinuous, as noted later. Each shroud ring 60 extends substantially parallel to the rotational axis 44 of the impeller 22, and has a radial thickness and an axial length. The axial length of each shroud ring 60 is defined as the axial distance between a tip 68 of that shroud ring 60 and the outer surface 66 of the shroud 30 from which the shroud ring 60 extends. The radial thickness of each shroud ring 60 is defined as the thickness of that shroud ring 60 in the radial direction.

Each shroud ring 60 has the same radial thickness, in this embodiment, but a different axial length to the other shroud rings 60. As best appreciated with reference to FIG. 2, the respective tips of two of the shroud rings 60 terminate generally in axial alignment with one another, and the remaining shroud ring 60 terminates at a different axial position that is closer to the impeller outlet 42. In other examples it would be possible for all of the shroud rings 60 to terminate at the same axial position, or for each shroud ring 60 to terminate at a different axial position.

Turning now to the housing rings 62, each housing ring 62 is defined by an annular projection that extends from an inner surface 72 of the housing 24. The housing rings 62 are radially spaced from one another on the housing 24 so as to define a pattern of concentric rings, and each housing ring 62 extends continuously about a circumference of the housing 24. As with the shroud rings 60, each housing ring 62 also extends substantially parallel to the rotational axis 44 of the impeller 22 and is generally rectangular in cross-section, but with slanted ends so as to better follow the contours of the outer surface 66 of the shroud 30 when the compressor 10 is assembled and the labyrinth seal arrangement 58 is formed. Each housing ring 62 has an axial length defined by the axial distance between a tip 76 of that housing ring 62 and the inner surface 72 of the housing 24 from which the housing ring 62 extends, and a radial thickness defined as the thickness of that housing ring 62 in the radial direction. The respective tips 76 of the housing rings 62 all terminate at different axial positions from one another in this example.

As best seen in FIG. 2, when the compressor 10 is assembled, the shroud rings 60 interdigitate or interlock with the housing rings 62 to define the labyrinth seal arrangement 58 in the leakage flow path 50.

The labyrinth seal arrangement 58 provides a tortuous flow path for air flowing through the leakage flow path 50 from the impeller outlet 42, thereby reducing the rate of air flow back towards the impeller inlet 40 through the leakage flow path 50, and advantageously reducing tip leakage. The configuration of the labyrinth seal arrangement 58, defined by a series of interdigitated rings 60, 62 and including as many of these rings 60, 62 as is possible based on the available package space, provides a highly circuitous route between the leakage flow path inlet 52 and the leakage flow path outlet 54, with the air flow required to change direction numerous times during passage through the leakage flow path 50.

It should be understood that many variations of the labyrinth seal arrangement 58 are possible within the scope of the invention. Although in the described embodiment each shroud ring 60 and each housing ring 62 extends substantially parallel to the rotational axis 44 of the impeller 22, the direction in which some or all of the shroud rings 60 and/or housing rings 62 extend may vary in other embodiments. For example, although in the illustrated embodiment the shroud rings are oriented axially, which is a benefit from a packaging perspective, in other embodiments, some or all of the shroud rings 60 and/or the housing rings 62 may extend substantially perpendicularly to the rotational axis 44 of the impeller 22, or in any other transverse/oblique orientation between the extremes of parallel and perpendicular to the impeller rotational axis 44.

In some embodiments, some or all of the shroud rings 60 and/or some or all of the housing rings 62 may be discontinuous. Such discontinuous rings 60, 62 may include gaps or spaces about their circumferential length, and thus be formed by multiple separate projections.

The axial lengths and radial widths of the shroud and/or housing rings 60, 62 may also vary in other embodiments, and the number and spacing of the shroud and/or housing rings 60, 62 may vary also. Furthermore, the cross-sectional shapes of some or all of the shroud and/or housing rings 60, 62 may vary in other embodiments.

Figure 4:
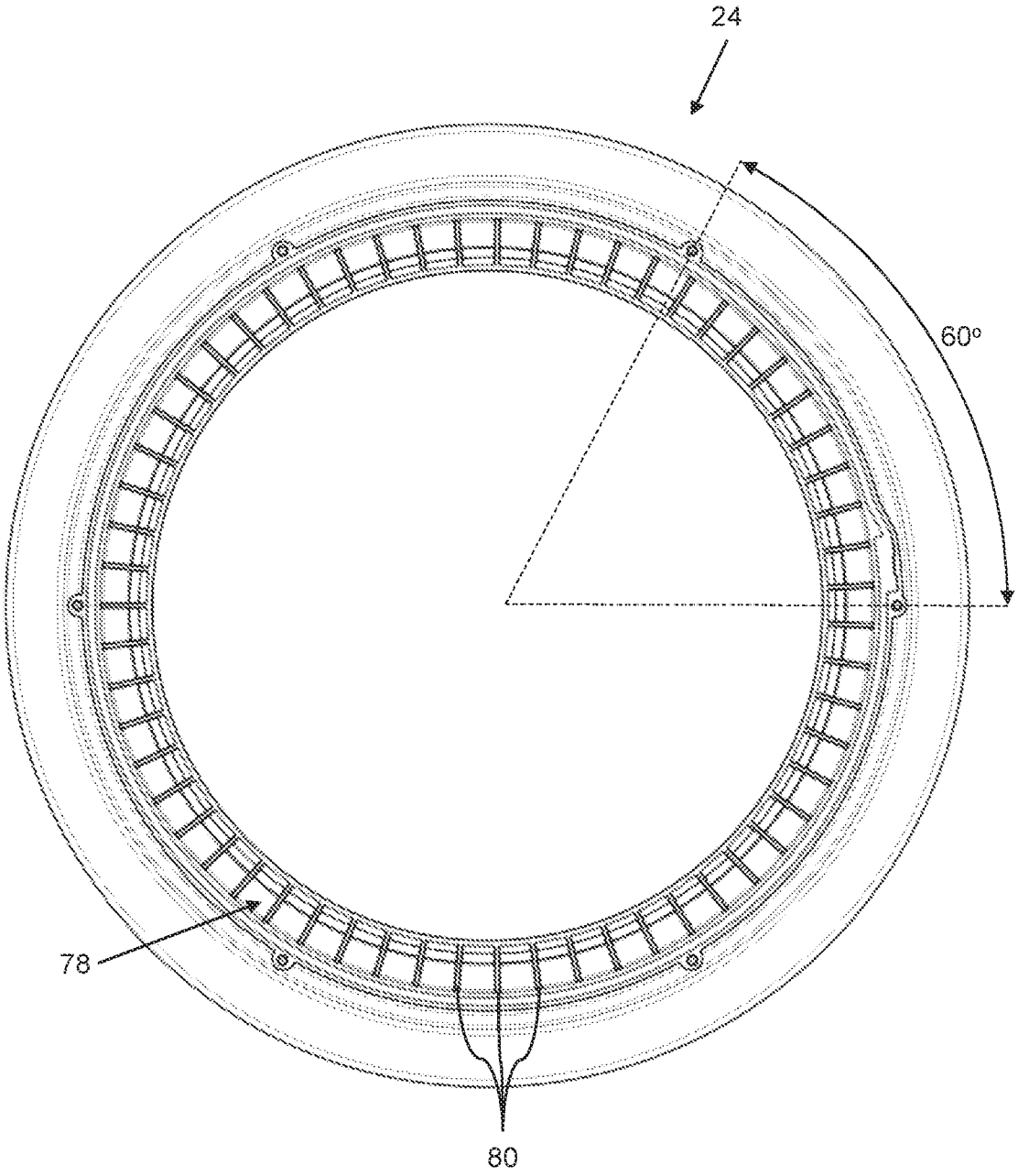
FIG. 4 is a plan view of the flow straightening arrangement of the compressor and the impeller of FIG. 2, comprising flow straightening vanes or fins.

Referring now to FIGS. 2, 3 and 4, in the illustrated embodiment the compressor 10 further comprises a flow straightening arrangement 78 for removing swirl in the airflow exiting the labyrinth seal arrangement 58 before its reinjection back into the impeller 22.

The flow straightening arrangement 78 comprises a plurality of straightening fins or vanes 80 and a circumferential wall 82. The circumferential wall 82 of the flow straightening arrangement 78 extends about the inner circumference of the flow straightening arrangement 78, as best seen in FIG. 3. The straightening vanes 80 are arranged in a ring about the rotational axis 44 of the impeller 22 in the assembled compressor 10, and are equally spaced about the rotational axis 44 of the impeller 22. The number of straightening vanes 80 is preferably as high as is possible without overly restricting the flow of air through the flow straightening arrangement 78, as maximising the number of straightening vanes 80 can shift tones generated on passage of air through the flow straightening arrangement 78 to higher frequencies. In particular, the number of straightening vanes 80 should be greater than the number of impeller blades 28 but is preferably not equal/is unequal to a multiple of the number of impeller blades 28 so as to avoid any increase in the tonality of the noise generated by the compressor 10. In the illustrated embodiment, the impeller 22 comprises seven impeller blades 22 and the flow straightening arrangement 78 comprises fifty nine straightening vanes 80. The number of straightening vanes 80 may vary in other embodiments but will be at least partially determined by space and manufacturing constraints.

Each straightening vane 80 has the same circumferential thickness in this embodiment, and neighbouring straightening vanes 80 are separated by gaps or spaces such that the circumferential distance between adjacent straightening vanes 80 is greater than the thickness of a vane 80. In this example the vane-to-space ratio, i.e. the ratio of vanes to free space about the circumference of the rotational axis 44 of the impeller 22, is around 1:6. The thickness and spacing of the straightening vanes 80 may vary in other embodiments but is preferably at least 1:4. In addition, the axial length of each straightening vane 80 is preferably greater than the circumferential distance between adjacent straightening vanes 80 such that the vanes define channels between them whose lengths are greater than their width.

Referring now to FIG. 2 in particular, the flow straightening arrangement 78 is provided at an outlet 84 of the labyrinth seal arrangement 58, and is positioned between the impeller shroud 30 and the housing 24. Specifically, an inlet 86 of the flow straightening arrangement 78 is provided at the outlet 84 of the labyrinth seal arrangement 58, such that air exiting the labyrinth seal arrangement 58 is delivered directly to the flow straightening arrangement 78.

An outlet 88 of the flow straightening arrangement 58 is spaced from the leakage flow path outlet 56 so as to define a wake recovery chamber 90 between the flow straightening arrangement 58 and the leakage flow path outlet 56, such that the wake recovery chamber 90 is upstream of the leakage flow path outlet 56 and downstream of the flow straightening arrangement 58. The wake recovery chamber 90 is defined between the outlet 88 of the flow straightening arrangement 78, the inner surface 72 of the housing 24 and the outer surface 66 of the shroud 30. The wake recovery chamber 90 acts as a flow homogenising zone between the flow straightening arrangement 78 and the leakage flow path outlet 56, that acts to homogenise the tonal content of the air flow exiting the flow straightening arrangement 78 before reinjection into the impeller inlet 40. The wake recovery chamber 90 therefore allows the aerodynamic wakes created by the straightening vanes 80 to mix out before interacting with the impeller blades 28 on reinjection into the impeller 22.

In this embodiment, the axial length of the flow straightening arrangement 78 is substantially equal to the axial distance between the outlet 88 of the flow straightening arrangement 78 and the leakage flow path outlet 56. In other embodiments, the ratio of the axial length of the flow straightening arrangement 78 and the axial distance between the outlet 88 and the leakage flow path outlet 56 may differ from this 1:1 ratio, provided that a suitable spacing exists between the outlet 88 and the leakage flow path outlet 56 to define the wake recovery chamber 90.

In prior art compressor arrangements that include straightening vanes, these vanes are typically provided as close as possible to the reinjection port through which the tip leakage is reinjected into the inlet of the impeller, so as to minimise the swirl added to the air flow by rotation of the shroud, between exiting the straightening vanes and being reinjected into the impeller.

As discussed above, the flow straightening arrangement 78 of the compressor 10 of the exemplary embodiment of the invention is positioned immediately downstream of the outlet 84 of the labyrinth seal arrangement 58, and the outlet 88 of the flow straightening arrangement 78 is spaced from the leakage flow path outlet 56 from where tip leakage is reinjected back into the impeller 22.

This specific location of the flow straightening arrangement 78 provides maximum aerodynamic benefit by removing the swirl in the air flow exiting the labyrinth seal arrangement 78, whilst minimising the acoustic impact of the wakes created by the straightening vanes 80 by providing the wake recovery chamber 90 between the flow straightening arrangement 78 and the leakage flow path outlet 56. However, the benefit of the inclusion of a wake recovery chamber 90 on acoustic impact is balanced with the benefit of minimising the distance between the flow straightening arrangement 78 and the reinjection port 56 to minimise the swirl added to the air as it flows from the flow straightening arrangement 78 to the leakage flow path outlet 56.

Although the flow straightening arrangement 78 comprises a plurality of straightening vanes 80 in the described embodiment, other arrangements are possible. For example, in other embodiments the flow straightening arrangement 78 may comprise a porous material, such as foam 92, for removing swirl from the incoming tip leakage flow, in place of or in addition to the straightening vanes 80. Alternatively or additionally, the flow straightening arrangement 78 may comprise a mesh 94.

Figure 5A:
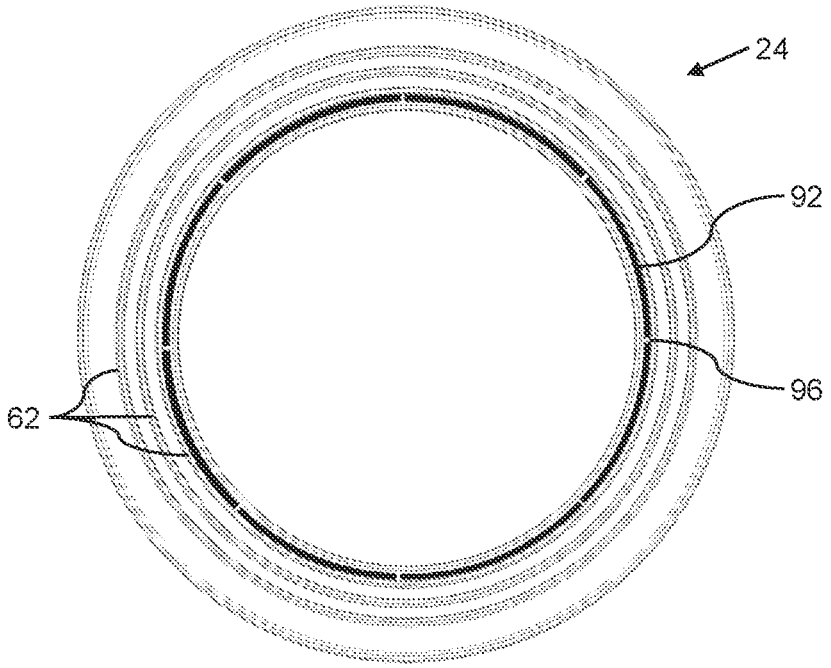
FIG. 5*a* is a plan view of an alternative flow straightening arrangement for use in a compressor of the invention, comprising a foam body.
Figure 5B:
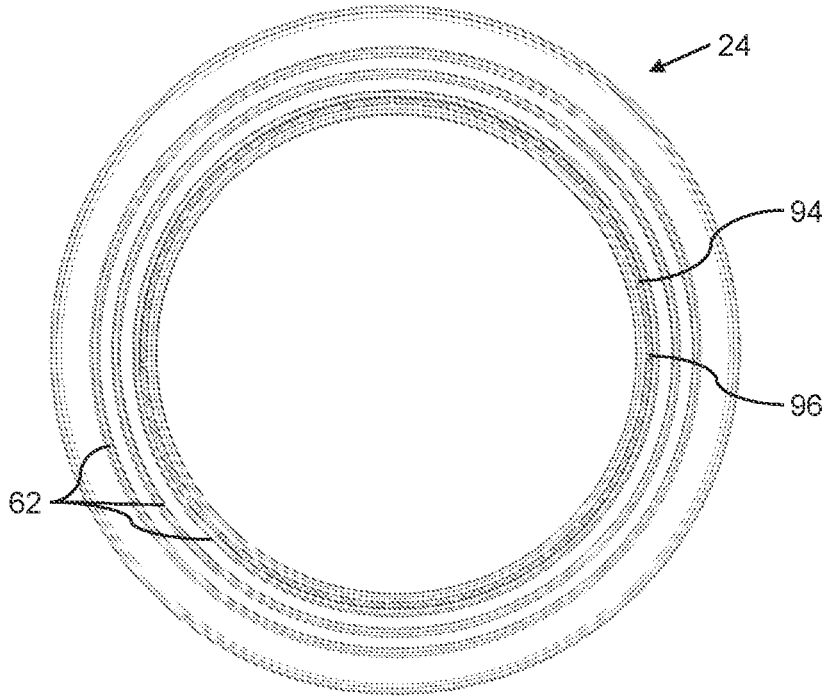
FIG. 5*b* is a plan view of another alternative flow straightening arrangement for use in a compressor of the invention, comprising a mesh.

FIG. 5*a* illustrates a flow straightening arrangement 78 that utilises foam 92, and in particular an open cell foam, in place of straightening vanes 80. FIG. 5*b* illustrates a flow straightening arrangement 78 that utilises mesh 94 in place of straightening vanes 80. As shown in these figures, in addition to the circumferential wall 82, these flow straightening arrangements 78 further include a plurality of radial walls 96 that extend between an inner surface of the housing 24 and the circumferential wall 82 and that segment the foam and mesh bodies 92, 94 of the arrangements.

The use of a foam material in the flow straightening arrangement 78 is advantageous, because the wakes generated by this material as airflow passes through the flow straightening arrangement 78 are less significant than those generated by discrete vanes or fins. In this way, a compressor 10 comprising a flow straightening arrangement 78 that utilises foam 92 may require a smaller distance between the outlet 88 of the flow straightening arrangement 78 and the leakage flow path outlet 56 for wake recovery, thereby reducing the opportunity for swirl to be re-added to the air flowing out of the flow straightening arrangement 78 before reinjection into the impeller inlet 40.

A compressor 10 in accordance with the invention therefore includes a labyrinth seal arrangement 58 formed by a series of interlocking rings 60, 62 that provide a highly circuitous, long and tight flow path between the shroud 30 and the housing 24 to reduce the flow rate of the tip leakage.

Furthermore, for air that does flow through the leakage flow path 50, and to which swirl is added due to boundary layer friction on the outer surface 66 of the rotating shroud 30, a flow straightening arrangement 78 may be provided. As explained, this flow straightening arrangement 78 is positioned and dimensioned to balance the benefits of providing spacing between its outlet 88 and the leakage flow path outlet 56 for wake recovery, with those of reducing the swirl added to the flow after exiting the flow straightening arrangement 78 but before reinjection into the impeller inlet 40.

Finally, it should be noted that although both a labyrinth seal arrangement and a flow straightening arrangement are included in the described exemplary embodiment, the labyrinth seal arrangement may be utilised without a flow straightening arrangement.

The invention claimed is:

1. A compressor for use in domestic appliances, the compressor comprising:

an impeller comprising an inlet, an outlet, a hub defining a rotational axis of the impeller, a plurality of impeller blades that extend from the hub and end in a blade tip, and a frustoconical shroud that at least partially surrounds the plurality of impeller blades, the shroud having an inner surface that connects to the blade tips, the impeller having an axial length;

a housing that at least partially surrounds the shroud and that is coaxially arranged with respect to the rotational axis of the impeller to allow the impeller to rotate within the housing;

a leakage flow path defined between the shroud and the housing leading from a leakage flow path inlet to a leakage flow path outlet, and a labyrinth seal arrangement provided in the leakage flow path, wherein the labyrinth seal arrangement comprises one or more shroud rings interdigitated with one or more housing rings so as to form a tortuous flow path for fluid flowing through the leakage flow path, the one or more shroud rings having a respective axial length, wherein the respective axial length of at least one of the one or more shroud rings is greater than 30% of the axial length of the impeller.

2. The compressor as claimed in claim 1, wherein one or more of the shroud rings and one or more of the housing rings extend substantially parallel to the rotational axis of the impeller.

3. The compressor as claimed in claim 1, wherein one or more of the shroud rings extends continuously about the shroud.

4. The compressor as claimed in claim 1, wherein one or more of the housing rings extends continuously about the housing.

5. The compressor as claimed in claim 1, wherein respective tips of two or more of the shroud rings terminate in axial alignment with one another.

6. The compressor as claimed in claim 1, wherein each of the respective axial lengths of the one or more shroud rings are greater than 30% of the axial length of the impeller.

7. The compressor as claimed in claim 1, comprising a flow straightening arrangement having an inlet at an outlet of the labyrinth seal arrangement.

8. The compressor as claimed in claim 7, wherein an outlet of the flow straightening arrangement is spaced from the leakage flow path outlet so as to define at least in part a wake recovery chamber upstream of the leakage flow path outlet.

9. The compressor as claimed in claim 8, wherein an axial length of the flow straightening arrangement is substantially equal to or less than an axial distance between the outlet of the flow straightening arrangement and the leakage flow path outlet.

10. The compressor as claimed in claim 7, wherein the flow straightening arrangement comprises a mesh.

11. The compressor as claimed in claim 7, wherein the flow straightening arrangement comprises a foam body.

12. The compressor as claimed in claim 7, wherein the flow straightening arrangement comprises a plurality of straightening vanes.

13. The compressor as claimed in claim 12, wherein the straightening vanes are equally spaced about the rotational axis of the impeller.

14. The compressor as claimed in claim 12, wherein a number of the plurality of straightening vanes is greater than a number of the plurality of impeller blades.

15. The compressor as claimed in claim 12, wherein a number of the plurality of straightening vanes is unequal to a multiple of a number of the plurality of impeller blades.

16. The compressor as claimed in claim 1, wherein the impeller is a mixed flow impeller.

17. A fan assembly comprising the compressor as claimed in claim 1.

18. A compressor for use in domestic appliances, the compressor comprising:

an impeller comprising an inlet, an outlet, a hub defining a rotational axis of the impeller, a plurality of impeller blades that extend from the hub, and a shroud that at least partially surrounds the impeller blades, the impeller having an axial length;

a housing that at least partially surrounds the shroud and that is coaxially arranged with respect to the rotational axis of the impeller to allow the impeller to rotate within the housing;

a leakage flow path defined between the shroud and the housing leading from a leakage flow path inlet to a leakage flow path outlet, and a labyrinth seal arrangement provided in the leakage flow path, wherein the labyrinth seal arrangement comprises one or more shroud rings interdigitated with one or more housing rings so as to form a tortuous flow path for fluid flowing through the leakage flow path, the one or more shroud rings having a respective axial length, wherein the respective axial length of at least one of the one or more shroud rings is greater than 30% of the axial length of the impeller, and, wherein the impeller inlet is arranged to receive fluid into the impeller and the impeller outlet is arranged to expel fluid out of the impeller, the impeller inlet and the impeller outlet being axially aligned along the rotational axis of the impeller.

* * * * *